US005360561A

United States Patent [19]

Hall et al.

[11] Patent Number: 5,360,561

[45] Date of Patent: Nov. 1, 1994

[54] COLOR TEMPERATURE INDICATOR FOR LUBRICATING GREASE

[75] Inventors: Robert S. Hall, Burlington; Gilles A. Blouin, Calgary, both of Canada

[73] Assignee: Shell Oil Company, Houston, Tex.

[21] Appl. No.: 66,749

[22] Filed: May 24, 1993

[30] Foreign Application Priority Data

May 29, 1992 [CA] Canada ..... 2070021

[51] Int. Cl.[5] ..... C10M 141/08

[52] U.S. Cl. ..... 252/42.7; 252/51.5 R

[58] Field of Search ..... 252/51.5 R, 42.7; 44/426, 429

[56] References Cited

U.S. PATENT DOCUMENTS

| | | | |
|---|---|---|---|
| 3,164,449 | 1/1965 | Buxbaum | 344/312 |
| 3,222,279 | 12/1965 | Loeffler | 252/28 |
| 3,594,125 | 7/1971 | Hamblin | 23/224 |
| 3,764,273 | 10/1973 | Turner et al. | 23/230 R |
| 3,883,568 | 5/1975 | Turner et al. | 260/383 |
| 3,933,657 | 1/1976 | Seni et al. | 252/29 |
| 4,764,290 | 8/1988 | Currey | 252/11 |
| 5,154,840 | 11/1992 | Drake et al. | 252/21 |

FOREIGN PATENT DOCUMENTS

| | | |
|---|---|---|
| 626227 | 8/1961 | Canada . |
| 88004600 | 4/1981 | Japan . |

*Primary Examiner*—John Niebling
*Assistant Examiner*—Edna Wong

[57] ABSTRACT

Lubricating compositions containing a color temperature indicator are disclosed. The compositions irreversibly change their color when exposed to temperatures exceeding a predetermined limit temperature. The compositions include, as an essential component, from 0.2% to 4% weight of metal dithiocarbamates or dialkyldithiocarbamates, preferably of antimony and/or lead in combination with a dye, preferably a blue dye, in an amount of from 50 ppm to 2000 ppm. Other components, such as epoxy resins, may be also present, to increase and/or extend the range of temperatures in which the changes of color are observed. The compositions are useful as indicators of overheating of lubricated elements under severe operating conditions.

4 Claims, No Drawings

COLOR TEMPERATURE INDICATOR FOR LUBRICATING GREASE

FIELD OF THE INVENTION

This invention relates to lubricating compositions acting as temperature indicators for the lubricated elements. More particularly, the invention relates to lubricating compositions comprising a color temperature indicator, which composition changes its color when exposed to temperatures exceeding a predetermined limit temperature, thus providing an indication of overheating of the lubricated element.

BACKGROUND OF THE INVENTION

The primary purpose of lubrication is separation of solid surfaces moving one relative to another, to minimize friction and wear. Solids and fluids (gases as well as liquids) are employed as lubricants. The materials most frequently used for this purpose are oils and greases. The choice of lubricant is mostly determined by the particular application.

Lubricating greases are employed where heavy pressures exist, where oil drip from the bearings is undesirable or where the motion of the contacting surfaces is discontinuous so that it is difficult to maintain a separating film in the bearing. Because of design simplicity, decreased sealing requirements and less need for maintenance, greases are almost universally given first consideration for lubricating ball and roller bearings in electric motors, household appliances, automotive wheel bearings, machine tools or aircraft accessories. Greases are also used for the lubrication of small gear drives and for many slow-speed sliding applications.

Lubricating greases consist primarily of a fluid lubricant, such as an oil, and a thickener. Essentially, the same type of oil is employed in compounding a grease as would normally be selected for oil lubrication. Of various available oils, petroleum oils are used most frequently, but many other natural or synthetic oils are employed to provide desirable physical and chemical properties of the produced greases. Fatty acid soaps of lithium, calcium, sodium, aluminum and barium are most commonly used as gelling agents. However, thickeners may be one of a variety of solid materials, including clays and pigments. Of these, clay-thickened greases are characterized by high dropping points, frequently higher than 260° C.

Various chemical additives are incorporated into lubricating greases, to impart certain desirable characteristics to the grease, such as oxidation stability, tackiness, extreme pressure properties and corrosion inhibition. Solid materials such as graphite, molybdenum disulfide, talc, metal powders, and various polymers may also be added to impart special properties.

Dyes or pigments are occasionally added to lubricating oils and greases. U.S. Pat. No. 4,764,290 discloses a method of providing identification to oil by dispersing in the oil particles of a hydrophilic dye which do not substantially change the color of the oil. When a sample of the oil is exposed to a polar solvent, the dye particles dissolve in the solvent providing a perceptible, intensive color. A similar identification system for non-water miscible organic liquids, including lubricating oils, is disclosed in U.S. Pat. Nos. 3,764,273 and 3,883,568.

Dyes or pigments may also be added to impart a distinct coloration to greases. Canadian Patent No. 626,227 discloses grease compositions containing as major gelling agent clays containing strongly adsorbed dyes. The greases so produced possess a characteristic identifying color which is additionally advantageous for determining if sufficient quantities of grease are present on the lubricated bearings.

Dyes or pigments may be added to lubricating compositions as detectors of unfavorable operating conditions. For example, Japanese Patent No. 88004600 discloses a water-detecting grease composition prepared by dispersing in the grease water soluble dyestuffs or pigments which exhibit a different color in the presence of water. The grease becomes distinctly colored when mixed with a small amount of water, so that the presence of water in the grease can be easily detected. This may be useful, for example, for checking sealing conditions of a lubricated part.

In mechanical equipment temperature is one of the most important operating parameters of its lubricated parts, such as bearings. The operation of the equipment results in an increase of temperature of the lubricated parts. For a given part, there is normally a maximum temperature which should not be exceeded under normal operating conditions. However, the maximum operating temperature may be exceeded under extreme operating conditions as a result of high ambient temperatures or mechanical malfunctions. Unless the temperature of the lubricated element is continuously monitored, such occasional or permanent overheating is likely to remain unnoticed, which may result in reduced lubricant effectiveness and potentially in irreversible damage to the equipment. It is therefore desirable to provide a simple method of detecting whether a predetermined limit temperature of the lubricated element has been exceeded during its operation.

SUMMARY OF THE INVENTION

It has now been found that this may be achieved by lubricating the element with a lubricating composition capable of irreversibly changing its color when exposed to temperatures exceeding a predetermined limit temperature. An overheating of the element may be detected by a simple visual inspection of the element to determine whether the lubricating composition has changed its color.

DETAILED DESCRIPTION OF THE EMBODIMENTS

According to one aspect, the invention provides a composition for lubricating equipment, indicating when the lubricant has exceeded a predetermined limit temperature, which composition includes a lubricant and a color temperature indicator, so that in use the composition irreversibly changes its color when exposed to a temperature exceeding the predetermined limit temperature.

According to another aspect, the invention provides a method of detecting an overheating of a lubricated element of mechanical equipment, which method includes:

lubricating the element with a lubricating composition comprising a color temperature indicator, which composition irreversibly changes its color at a temperature exceeding a predetermined limit temperature, and inspecting, usually visually, the lubricated element for changes of color of the lubricating composition to determine whether the temperature of the element has exceeded the limit temperature during the operation of the equipment.

The color temperature indicator according to the invention is a substance or a composition of matter which, when incorporated into a lubricating composition, is capable of producing an irreversible change of color when the lubricating composition is exposed to temperatures exceeding a predetermined limit temperature.

A. Main Components of Indicator

An essential component of the color temperature indicator according to the invention is metal dithiocarbamates or dialkyldithiocarbamates and mixtures thereof. Of these, antimony or lead dithiocarbamates or dialkyldithiocarbamates and mixtures thereof are preferred. Antimony dithiocarbamate and dialkyldithiocarbamates are particularly preferred. These substances, when incorporated into a lubricating composition, may produce a change of color of the composition exposed to an excessive temperature for a period of time. They are incorporated into lubricating compositions in any amount of from about 0.2% to about 4% by weight, preferably from about 0.7% to about 1.8% by weight, and most preferably about 1.25% by weight.

B. Additional Components

The initial color of the lubricating composition, the produced changes of color and the range of temperature in which these changes are observed may be affected by additional components of the color temperature indicator. In particular, a dye provides a distinct initial coloration to the lubricating composition and usually determines the range of colors in which the changes of colors are observed. Other components, such as epoxy resins, for example EPON 838 TM epoxy resin, change and/or extend the range of temperatures in which the changes of color are observed. The concentration of dyes may vary in a broad range, depending on the type of dye, the desired initial color and the lubricant. For clay-thickened greases, epoxy resins are added in an amount of from about 0.1% to about 20% by weight, preferably from about 0.1% to about 10% by weight, most preferably about 3% by weight. However, the amounts of the components of the color temperature indicator required as well as the limit temperatures and corresponding changes of color will depend on the particular application.

Metal dithiocarbamates and dialkyldithiocarbamates are frequently used as additives imparting to lubricating compositions antiwear, extreme pressure and antioxidant properties. As such, they make part of various commercially available compositions, such as VANLUBE TM 8610,VANLUBE TM 71, VANLUBE TM 73 or VANLUBE TM 74 (products of R. T. Vanderbilt Company Inc.).

Preferred color temperature indicators according to the invention use additive compositions VANLUBE TM 8610 or VANLUBE TM 73 in combination with a dye, preferably a blue dye, most preferably AUTOMATE BLUE 8 TM dye. However, other dyes may be used in combination with these additives to provide different initial colors and/or different color changes. The combination of VANLUBE TM 8610 additive composition with AUTOMATE BLUE 8 TM dye is particularly preferred.

VANLUBE TM 8610 and VANLUBE TM 73 are extreme pressure and antiwear agents with good oxidation inhibiting properties. VANLUBE TM 8610 contains a synergistic combination of antimony dithiocarbamate and a sulfurized olefin, whereas VANLUBE 73 contains antimony dialkyldithiocarbamate. These agents have the following typical properties:

| | VANLUBE TM 8610 | VANLUBE TM 73 |
|---|---|---|
| Physical state: | liquid | liquid |
| Color: | dark brown | dark amber |
| Density at 25° C., $Mg/m^3$ | 1.13 | 1.04 |
| Flash point, COC, °C.(°F.) | 110 (230) | 171 (304) |
| Viscosity at 100° C., Cst (SUS) | 15.0 (77.9) | 11.6 (65) |
| Antimony content, weight % | 7.3 | 6.8 |
| Sulfur content, weight % | 36.0 | 10.0 |

AUTOMATE BLUE 8 TM is a mixture of symmetrical and unsymmetrical N,N-dialkylamino anthraquinones, wherein alkyl may be methyl, amyl or 2-ethylhexyl and is available from Morton Thiokol, Inc.

The amount of the VANLUBE TM additive composition in the lubricating composition according to the invention is normally from about 0.5% to about 7% by weight, preferably from about 1.5% to about 3.5% by weight, most preferably about 2.5% by weight. The amount of the dye is normally in the range of from about 50 ppm to about 2000 ppm, preferably from about 500 ppm to about 1000 ppm, most preferably about 800 ppm. However, the amounts of the dye as the other components of the color temperature indicator may vary depending on the lubricating composition, its particular application or the required intensity of the initial color and color changes to be achieved.

C. Effect of Indicator

The color temperature indicator or any component thereof may serve additional purposes in the lubricating composition by providing it with other desirable properties such as oxidation resistance or extreme pressure and antiwear properties. The indicator should not adversely affect lubricating properties of the composition and should show sufficient stability in the whole range of temperatures for which the lubricating composition has been designed.

Preferred color temperature indicators are those imparting a distinct initial color to the composition, which color changes continuously over a broad range of temperatures, for example, from about 100° C. to about 170° C. or higher, and over a broad range of colors, thus providing a semi-quantitative indication of the maximum temperature to which the lubricated composition and the lubricated element were exposed during the operation. However, color temperature indicators having a relatively low limit temperature, such as about 80° C. may be also useful, for example, as indicators that a different lubricating composition should be used under the operating conditions at which the change of color of such an indicator is observed.

D. Rate of Color Change

The rate of the change of color observed for the color temperature indicator according to the invention depends on temperature and increases with increasing temperature. For temperatures in the range of 80° C. to 100° C., and exposure of 48 hours or more may be necessary to produce a perceptible change of color. For temperatures of about 170° C., the change normally takes place within a few hours. The rate of change of color will depend on the particular composition.

E. Use of Indicators

The color temperature indicators according to the invention are preferably incorporated into lubricating greases. Of these, clay-thickened greases, for example, those containing bentonite or hectorite clays are preferred. MICROGEL TM greases, such as DARINA TM, DARINA AX TM, DARINA EP TM, DARINA XL TM and EXTREMA TM, SURSTAY TM or DURSOL TM are particularly preferred.

A lubricating composition comprising a color temperature indicator according to the invention is capable of irreversibly changing its color under severe operating conditions. This change of color indicates a temporary or permanent overheating of the lubricated element, which overheating may be due, for example, to insufficient lubrication. The discoloration may therefore indicate the need to lubricate the element more frequently or to replace the grease. The overheating and the accompanying discoloration of the lubricating composition may be also due to mechanical problems in the equipment. In some cases a specific pattern of discoloration may occur within the lubricated element and may help in identification of the problem. For example, the discoloration appearing only on one side of a large bearing might indicate a misalignment causing high temperature on one side of the bearing.

The invention will be further described by way of preferred embodiments and illustrative examples.

EXAMPLES

Example 1

457 g of clay-thickened pregrease was mixed with 35.6 g of AX oil (70:30 by weight mixture of mineral oil HVI-580 and mineral oil HVI-BS), 10 g of VANLUBE TM 8610 and 3 g of VANLUBE TM RIA. 0.35 g of AUTOMATE BLUE 8 TM dye was subsequently added and the mixture was milled in a homogenizer at 2500 psi. Samples of this composition changed color from blue to brown/green when kept in an oven at 130° C. for about 24 hours.

Example 2

| | |
|---|---|
| EXTREMA EPS TM pregrease | 1833.3 g |
| AX oil | 113.1 g |
| VANLUBE TM 8610 | 40.0 g |
| VANLUBE TM RIA | 12.0 g |
| AUTOMATE BLUE 8 TM | 1.6 g |

The listed components were milled in a homogenizer at 1500 psi. Samples of the composition retained their blue color in an oven at 80° C. and 100° C. They turned green at 120° C. and olive green to yellow green at 140° C.

Example 3

A mixture of

| | |
|---|---|
| Li Soap pregrease | 4846.40 g |
| AX oil | 100.00 g |
| VANLUBE TM 8610 | 40.00 g |
| VANLUBE TM RIA | 12.00 g |
| AUTOMATE BLUE 8 TM | 1.60 g |

was milled in a homogenizer at 2000 psi. Samples of the composition retained their blue color at 80° C., 100° C. and 120° C. A slight darkening of samples was observed at 140° C.

Example 4

The following lubricating composition (also known as DARINA XL EP-2 TM):

| | |
|---|---|
| Mineral oil HVI-580 | 56.57% wt. |
| Mineral oil HVI-BS | 24.25% |
| Hectorite clay | 6.50% |
| Polyamine blend (Alkamide 1334 TM) | 0.82% |
| Phosphoric acid | 0.83% |
| Epoxy resin (EPON 828 TM) | 3.51% |
| N,N-dimethyl(hydrogenated tallow)amine | 1.91% |
| Lard oil | 1.91% |
| VANLUBE TM 8610 | 2.00% |
| VANLUBE TM RIA | 0.60% |
| Epolene TM C-16 | 1.00% |
| Nuodex TM 635 | 0.10% |

when mixed with 800 ppm of AUTOMATE BLUE 8 TM dye has a blue color which does not change below 80° C. Above this temperature the changes of color are as follows:

at approximately 100° C.—grease turns green
at approximately 140° C.—grease turns brown
at approximately 170° C.—grease turns orange The grease in this Example 4 had about a 0.54 epoxy resin-to-clay weight ratio.

Example 5

A composition, as in Example 4, containing 2.5% of VANLUBE TM 73 instead of VANLUBE TM 8610 shows no change of color at temperatures 80° C. and 100° C. It turns dull green at 120° C. and purple at 140° C.

Example 6

The following lubricating composition (also known as DARINA XL MS TM)

| | |
|---|---|
| Mineral oil HVI-580 | 17.74% wt. |
| Mineral oil HVI-BS | 7.61% |
| Mineral oil MVI-60 | 59.17% |
| Hectorite clay | 5.25% |
| Polyamine blend Alkamide 1334 TM) | 0.66% |
| Phoshoric acid | 0.67% |
| Epoxy resin (EPON 828 TM) | 2.84% |
| N,N-dimethyl (hydrogenated tallow)amine | 1.58% |
| Lard oil | 1.58% |
| VANLUBE TM 8610 | 2.00% |
| VANLUBE TM RIA | 0.60% |
| Epolene TM C-16 | 0.25% |
| Nuodex TM 635 | 0.05% |

when mixed with 800 ppm of AUTOMATE BLUE 8 TM dye has a blue color which turns green at about 80° C.

What is claimed is:

1. A lubricating composition comprising a clay-thickened grease, from about 0.5% to about 7% by weight of an extreme pressure agent, an epoxy resin wherein said epoxy is present in about a 0.54 epoxy resin-to-clay weight ratio, a color temperature indicator incorporated into said composition, and from about 100 ppm to about 2000 ppm of a blue dye.

2. The lubricating composition according to claim 1 comprising from about 1.5% to about 3.5% by weight of the extreme pressure agent, and from about 500 ppm to about 1000 ppm of the blue dye.

3. The composition according to claim 2, wherein the blue dye consists essentially of a mixture of symmetrical and unsymmetrical N,N-dialkylamino anthraquinones, wherein the alkyl may be methyl, amyl or 2-ethylhexyl.

4. The composition according to claim 1, wherein the grease is a bentonite or hectorite clay-thickened grease.

* * * * *